US005307057A

United States Patent [19]

Cook et al.

[11] Patent Number: 5,307,057

[45] Date of Patent: Apr. 26, 1994

[54] FIBER OPTIC DISPLAY SYSTEM UTILIZING A DUAL LIGHT SOURCE

[75] Inventors: Kenneth J. Cook; Thomas E. Stack, both of Troy; Jeffry B. Stout, Dearborn; Donald J. Davis, Pontiac; Anwar Bawadekji, Rochester Hills, all of Mich.

[73] Assignee: Vultron, Inc., Rochester Hills, Mich.

[21] Appl. No.: 751,194

[22] Filed: Aug. 29, 1991

[51] Int. Cl.[5] ..... G08B 5/00; G09F 19/12

[52] U.S. Cl. ..... 340/815.42; 340/815.47; 340/815.77

[58] Field of Search ..... 340/815.01, 815.03, 340/815.04, 815.07, 815.12, 815.15, 815.19, 815.24, 815.27, 815.31

[56] References Cited

U.S. PATENT DOCUMENTS

| | | | |
|---|---|---|---|
| D. 298,146 | 10/1988 | Glover | D20/12 |
| 1,105,829 | 8/1914 | Plummer et al. | 340/815.18 |
| 2,442,569 | 6/1948 | Kennelly | 340/815.19 |
| 3,909,823 | 9/1975 | Knowlton | 340/336 |
| 3,916,403 | 10/1975 | Mandzsu et al. | 340/378 R |
| 3,962,702 | 6/1976 | Kriege | 340/815.31 |
| 4,069,480 | 1/1978 | Helwig | 340/373 |
| 4,325,062 | 4/1982 | Devlin | 340/717 |
| 4,353,063 | 10/1982 | Devlin | 340/798 |
| 4,951,405 | 8/1990 | Sabala | 40/551 |
| 5,021,773 | 1/1991 | Browne | 340/815.31 |

OTHER PUBLICATIONS

Schott Glaswerke, Wiesbaden, Germany, product catalog.

*Primary Examiner*—Ulysses Weldon
*Assistant Examiner*—M. Fatahiyar
*Attorney, Agent, or Firm*—Calfee Halter & Griswold

[57] ABSTRACT

A fiber optic display sign is provided comprising a plurality of magnetically actuatable indicator elements, each having associated therewith at least two fiber optic cables for transmitting light. Each of the fiber optic cables has an end face for emitting light which terminates in an indicator element, and an end face for receiving light which is positioned in close proximity with the other light receiving end faces to form a light receiving surface. A light source assembly moveable with respect to the light receiving surface includes a primary light source and a secondary light source each adapted to illuminate the light receiving surface when aligned therewith. The light source assembly is alternatively moveable to a first position at which the primary light source is aligned with the light receiving surface or a second position at which the secondary light source is aligned with the light receiving surface. An electronic circuit detects an interruption in the current through the primary light source and provides an electrical signal in response thereto. A solenoid responds to the electrical signal by moving the light source assembly from the first position to the second position and energizing the secondary light source.

8 Claims, 11 Drawing Sheets

1A 1B 5A 5B 7A 7B

FIBER OPTIC DISPLAY SYSTEM UTILIZING A DUAL LIGHT SOURCE

TECHNICAL FIELD

The present invention relates generally to display systems and more specifically to a fiber optic display system having dual light sources for alternatively illuminating the fiber optic cables in the system.

BACKGROUND OF THE INVENTION

Display signs having surfaces which are in part formed by the light emitting ends of fiber optic cables have numerous indoor and outdoor applications. Some examples of these applications include outdoor highway signs, airport arrival/destination signs, and bus destination signs. By forming a part of the display surface of the sign with the light emitting ends of the fiber optic cables, the signs are visible at a greater distance than signs having surfaces which are not enhanced by fiber optic illumination.

An example of the use of fiber optic illumination of display signs is in the field of manually changeable message signs. In such signs, a plurality of fiber optic cables are bundled at one end and positioned in front of a light source. The other ends of the cables are arranged in a predetermined configuration on the display surface of the sign to provide the desired message. The drawback to such a display system is that the message provided by a single bundle of fibers is not changeable unless the ends of the fibers opposite the light source are physically reconfigured to produce another message.

Automatically changeable message signs using non-fiber optic elements are known in the art. An example of such a sign is disclosed in U.S. Pat. No. 3,916,403 to Mandzsu, et al., wherein magnetic indicator elements are magnetically flipped to produce a variety of messages. The technology referred to in the Mandzsu patent is commonly referred to as flip-dot technology in the art. The indicator elements are arranged in an array or matrix. By computer controlling the locations in the matrix at which indicator elements are magnetically flipped, a variety of messages may be produced. The indicating elements are typically painted a highly visible color to enhance sign visibility.

Thus, it is an object of the present invention to provide an automatically changeable message sign implementing flip-dot technology wherein light emitting end faces of fiber optic cables terminate at the surface of the indicator elements.

In any fiber optic system, however, the effective operation of the light transmitting fibers depends on an operational light source for illuminating the fibers. If the light source should fail, the fiber optic cables are rendered ineffective. Thus, it is desirable to provide a secondary light source in a fiber optic display system, to ensure continuous message display upon failure of the primary light source.

It is known to use a conventional prism beam splitter to split a light beam into two components, each of which can be used to illuminate a separate bundle of optical fibers. A pair of light sources may be located adjacent opposite surfaces of the prism so that each of the light sources can alternatively provide a source of light to both of the fiber optic bundles without changing position with respect to the prism. However, in such a system, a portion of the illumination provided by the light source is lost due to interference at the prism face.

In addition, the illumination provided by the light source must be shared by two optical fiber bundles, reducing the illumination capacity of any one bundle.

Thus, it is another object of the invention to provide a fiber optic display system which provides primary and secondary light sources which alternatively shine light directly into bundled ends of fiber optic cables, the secondary light source automatically energizing upon failure of the primary source.

SUMMARY OF THE PRESENT INVENTION

According to the present invention, a fiber optic display system is provided which implements computer controlled flip-dot technology to provide the capability for displaying a large number of messages, the visibility of which is enhanced by illuminated ends of fiber optic cables which terminate at the display surface. A primary light source provides the light beam required to illuminate bundled light receiving ends of the cables opposite the terminated ends. A secondary identical light source is adapted to electromechanically assume the position of the primary light source and energize upon failure of the primary light source. Visual indication means are provided to indicate which of the two light sources is currently operational. In addition, the display system provides two independent air circulation systems to separately (i) cool the active primary or secondary light source, whichever is operative, and (ii) dissipate heat generated by sunlight shining upon the display surface and internal electronic circuitry.

The fiber optic display system comprises an array of magnetically operated indicating elements each comprising a permanent magnet flip-member displaying the information on a base panel and an electromagnet excitable in a bipolar manner to control the flip-members. Each of the electromagnets has an excitation coil which is connected across an electronic control unit which provides bipolar control signals for selective excitation of the coils to produce the visual information display.

The array of magnetically operated indicating elements comprises a plurality of display modules, each having a display surface formed by a matrix of the of magnetically operated indicating elements. The display modules are arranged together to form the complete system display. Each of the modules includes a plurality of fiber optic cables for transmitting light to the indicating elements, and dual light sources for alternatively lighting the fiber optic cables.

Each of the fiber optic cables in the module has an end face for receiving light and an end face for emitting light. The light emitting end faces terminate on the base panels of the indicating elements making up the display surface. Illumination of the fiber optic cables, then, enhances the visibility of the sign. The light receiving ends of the fiber optic cables are positioned in close proximity with each other so that the fibers may be illuminated by one of the dual light sources. The light receiving ends of the cables are bundled together so that the adjacent light receiving end faces form a generally planar light receiving surface. The dual light sources are adapted to alternatively shine light upon this generally planar surface to illuminate the fiber optic cables and, hence, the light emitting end faces terminating at the bases of the indicating elements.

The dual light sources comprise a primary light source and a secondary light source each adapted to alternatively illuminate the generally planar light receiving surface when aligned therewith. The primary and secondary light sources are mounted so that they may be alternatively positioned in alignment with the generally planar surface. In the primary operational mode, the primary light source is energized and aligned with the generally planar surface so that the fiber optic cables are illuminated.

A current sensing circuit senses any interruption in the current through the primary light source, and provides a control signal in response thereto. A solenoid connected to the current sensing circuit is activated by this control signal to move the secondary light source into a position aligned with the light receiving ends of the fiber optic cables. The current sensing circuit also provides means to energize the secondary light source. Thus, the indicating elements in the display remain illuminated notwithstanding the failure of the primary light source.

DETAILED DESCRIPTION OF THE PREFERRED EMBODIMENT

Figure 1A:
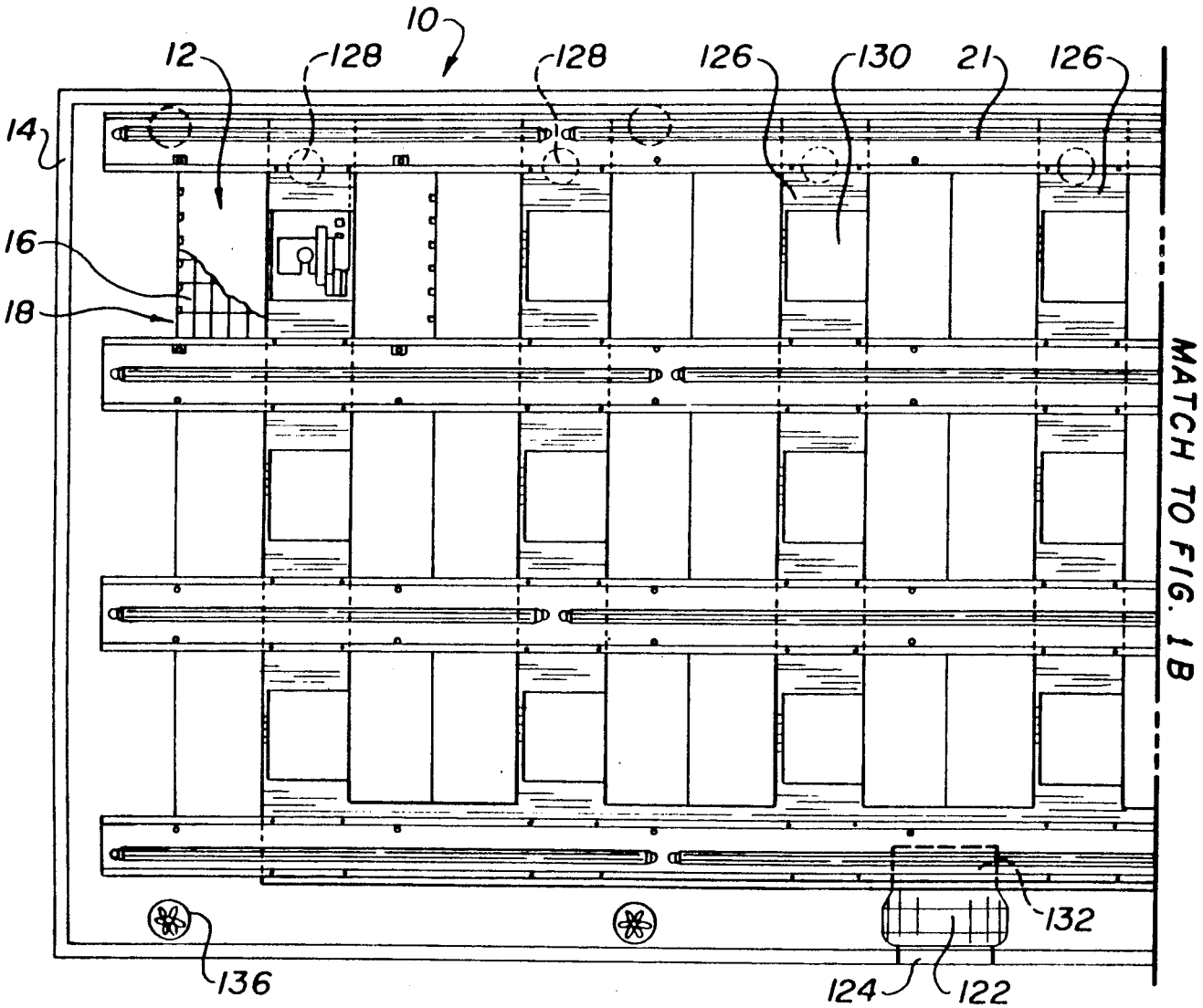
FIGS. 1A and 1B, taken together, form a fragmentary, frontal view of the display system constructed according to the principles of the present invention.
Figure 1B:
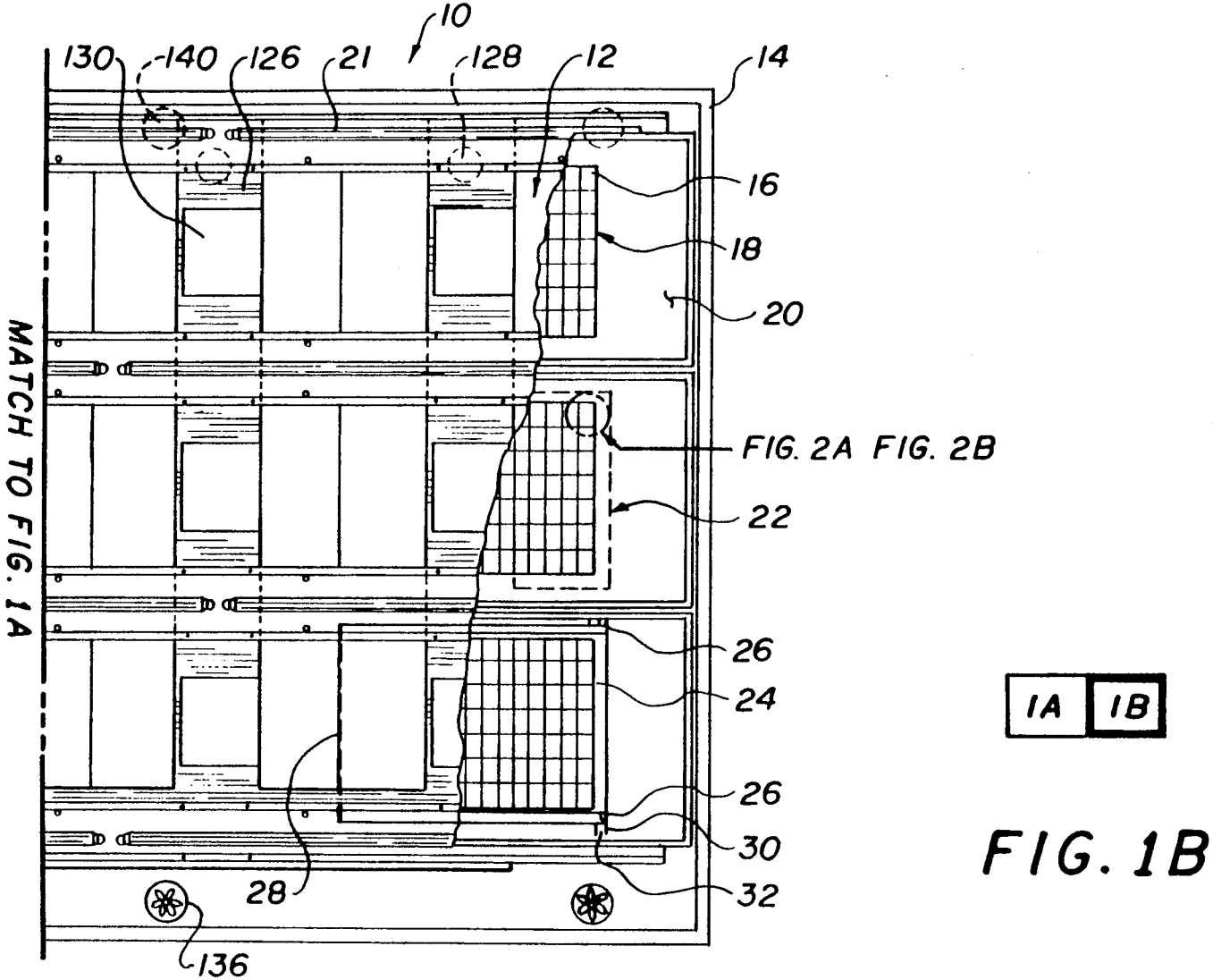

The fiber optic display system of the present invention is shown generally at 10 in FIGS. 1A and 1B, taken together. The display system 10 comprises an arrangement of identical fiber optic display modules 12 mounted in an aluminum system enclosure 14. Each of the display modules 12 has a plurality of indicator elements 16 forming a matrix 18. In the embodiment shown in FIG. 1, eighteen display modules are mounted in the aluminum enclosure in three rows of six adjacently positioned modules. Each of the three rows of modules forms a separate display surface comprising six adjacent matrices of indicator elements for displaying messages. The messages are viewable through transparent windows 20 which cover the front of the enclosure 14. The windows 20 and the matrices of the indicator elements are shown in fragmentary view to better illustrate the construction of the display system 10. To enhance visibility of the display surface during night time hours, the display surface is additionally illuminated by fluorescent lamps 21 mounted within the enclosure The indicator elements 16 forming the matrix on each of the display modules 12 are electromagnetically operated elements which are known in the art. Such indicator elements are described in U.S. Pat. No. 3,916,403 to Mandzsu, incorporated by reference herein. By selectively and electromagnetically actuating the indicator elements, messages may be displayed on the three display surfaces of the system. Control means (not shown) are utilized to select the locations on the matrix at which the indicator elements are activated or deactivated to determine the message to be displayed. It is to be understood that the control means for determining which of the indicator elements is activated at any given moment is conventional and known in the art and will therefore not be described herein.

The display matrix 18 of indicator elements 16 in each module comprises three 5×7 sub-matrices 22 of indicator elements. Hence, the entire display matrix 18 for each module 12 comprises 105 indicator elements. Each of the indicator elements in the sub-matrix 22 is attached to a steel cage 24 having slots therein for receiving the individual indicator elements. The steel cages 24 are preferably painted flat black to maximize the contrast between the indicator elements and the cage, which serves as a background for the indicator elements. The three steel cages 24 having the indicator elements attached thereto are attached side by side to rails 26 extending along the upper and lower edges of the adjacent cages. These rails are hingedly attached at one end to the enclosure 14 with hinges 28. The other ends of the rails are provided with slotted extensions 30 which are secured to the enclosure by bolts 32 which may be removed to enable the display matrix to be swung outwardly from the enclosure for servicing.

Figure 2A:
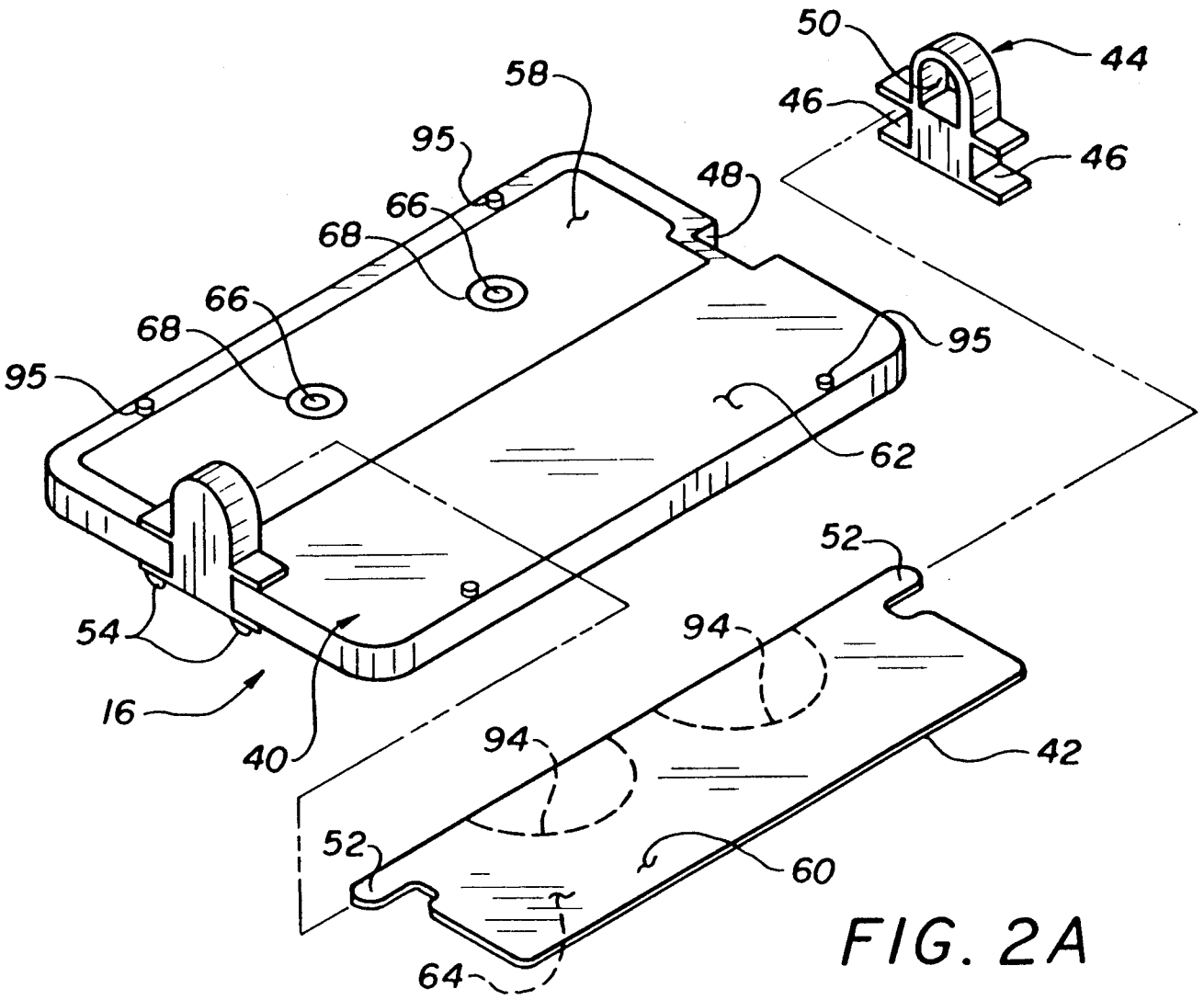
FIG. 2A is a perspective, exploded view of one of the magnetic indicator elements used in the display system of FIG. 1.

FIG. 2A better illustrates the construction of the individual indicator elements 16 used to construct the message display surface of the system. Each of the indicator elements 16 comprises a indicator base 40, a flipper 42, and a pair of pivot ears 44.

In the preferred embodiment, the indicator base 40 and the pivot ears 44 are constructed from a plastic material, and the flipper 42 is aluminum, although it is contemplated that the flipper may be constructed from plastic as well. The pivot ears 44 are provided with slots 46 which engage notches 48 on the indicator base 40, and recesses 50 which capture flipper extensions 52 as the pivot ear is installed onto the indicator base. The pivot ears thereby enable rotational movement of the flipper with respect to the indicator base. The assembled indicator element 16 is then installed in the cage 24 by means of compressible base extensions 54 which engage slots 56 in the cage (see FIG. 2B).

One half of the indicator base (indicated at 58) and one side of the flipper (indicated at 60) are either (i) painted a highly visible color which contrasts the color of the cage, or (ii) have attached thereto a highly visible and reflective film or coating. The other half (62) of the indicator base and the other side (64) of the flipper are preferably painted black or coated with a black film to match the color of the steel cage. Thus, the flipper 42 may rotate 180° with respect to the base 40 from (i) a first position wherein the flipper covers the brightly colored half of the indicator base to (ii) a second position wherein the flipper covers the black half of the indicator base. In the first position, the indicator element appears bright, while in the second position the indicator element appears dark.

Hence, rotation of the flipper between these two positions creates mutually contrasting visual effects in the two positions. In addition, the light emitting end faces of a pair of fiber optic cables 66 are installed in ferrules 68 which terminate at the face of the indicator base, enhancing the visibility of the indicator when the flipper 42 is in the second position.

Figure 2B:
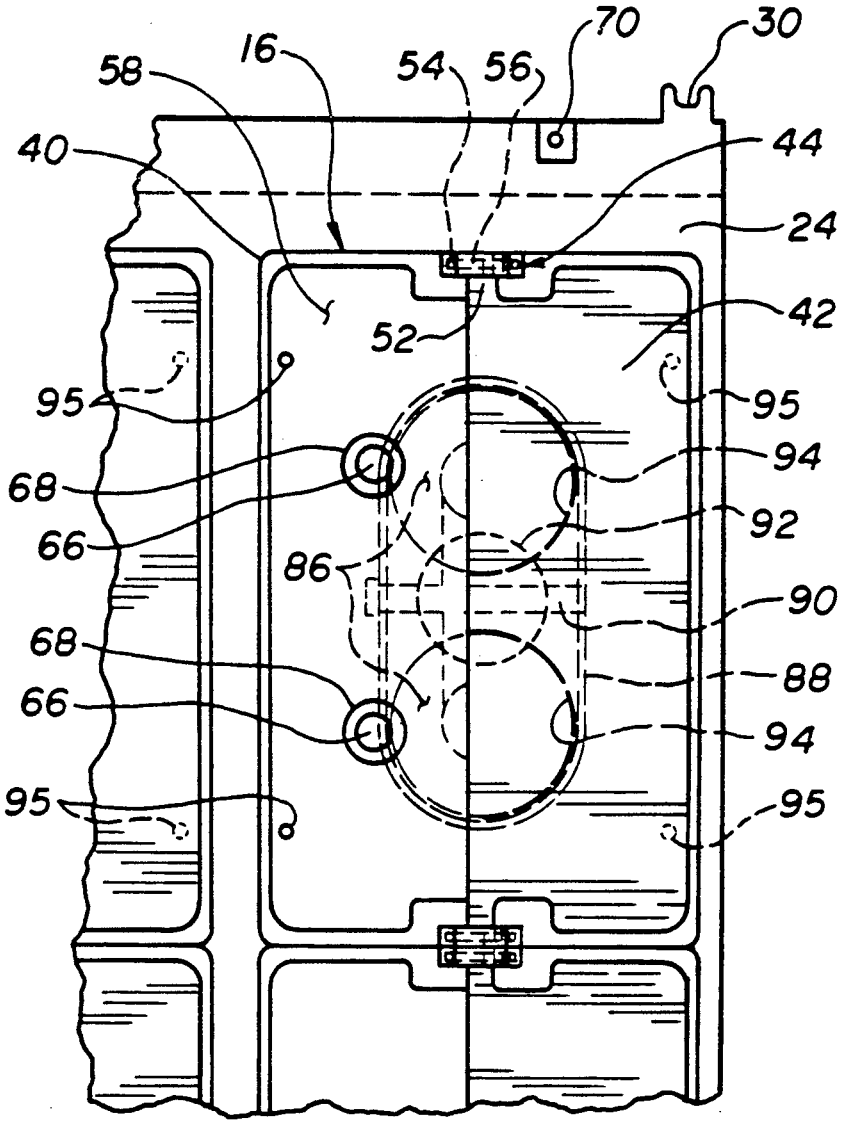
FIG. 2B is a detailed planar view of one of the magnetic indicator elements used in the display system of FIG. 1.

FIG. 2B shows the indicator element installed within its steel cage 24. The steel cage 24 is provided with mounts 70 for attaching a printed circuit card 72 (see FIG. 3) to the cage. The printed circuit card contains the circuitry required to route control signals to the indicator elements. Such circuitry is known in the art and is not fully described herein. The control signals provided by such circuitry are connected to electromagnets 86 located under each of the indicator bases 40. In the preferred embodiment, each of the electromagnets 86 is in the shape of a horseshoe and fits into a locator chamber 88 formed in the indicator base 40 and extending downwardly from the display surface. Tie wraps 90 are used to secure the electromagnets to the indicator base. Access holes 92 in the printed circuit card 72 located at each of the electromagnet locations permit the fiber optic cables 66 to pass through the circuit card 72 and connect into the indicator base 40.

Attached to the dark side of the flipper 42 are a pair of oppositely polarized semicircular permanent magnets 94, each of which aligns with a pole on the horseshoe magnet. Because the poles on the electromagnet are also oppositely polarized regardless of the direction of current flow through the electromagnet coil, the position of the flipper 42 with respect to the indicator base can be controlled by electronically controlling the current through the coil. In the preferred embodiment of the invention, stops 95 extending from the indicator base 40 prevent the flipper 42 from contacting the indicator base 40. The stops thereby prevent the flipper and the base from sticking to each other should the coating or paint thereon become sticky due to heat.

Figure 3:
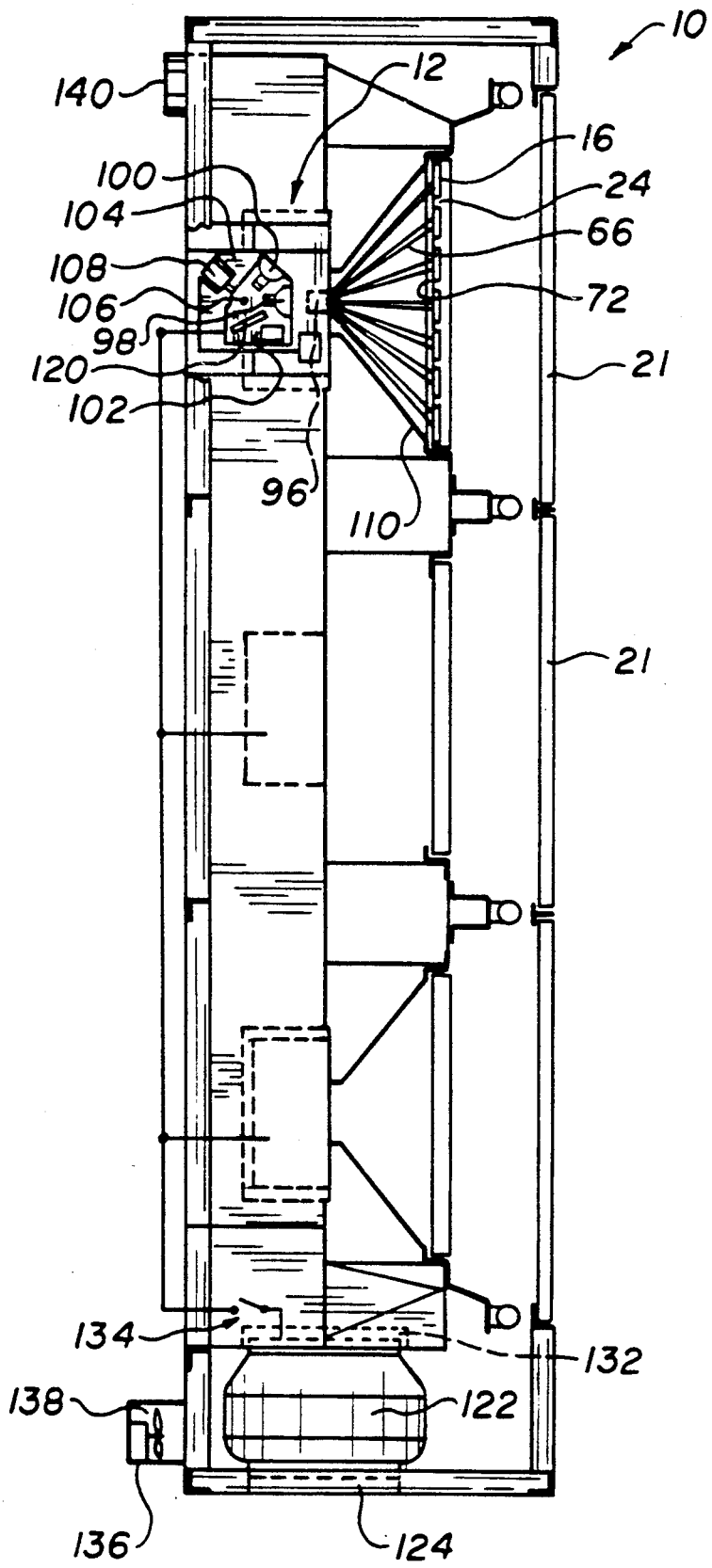
FIG. 3 is a sectional side view of the display system of FIG. 1.

FIG. 3 is a sectional view of the system shown in FIGS. 1A and 1B, and better illustrates the construction of one of the fiber optic display modules 12 which form the message display surfaces of the system. Each module 12 comprises the matrix of indicator elements 16 attached to the cage 24, a pair of fiber optic cables 66 for each indicator element, the light emitting end faces of which terminate at the display element indicator base and the light receiving end faces of which are bundled together within a common ferrule 96, and a pair of light sources 98 and 100 for illuminating the bundled end face of the fiber optic cables 66.

The light sources 98 and 100 are attached to a rocker plate 102 which is in turn pivotally mounted to a light source assembly frame 104 by means of a bolt 106. By pivoting the rocker plate 102 between two positions, using a solenoid 108, the light sources 98 and 100 may be alternatively aligned with the ferrule 96 which is fixedly attached to the frame 104. Support members 110 are used to attach the cage 24 to the frame 104.

Figure 4A:
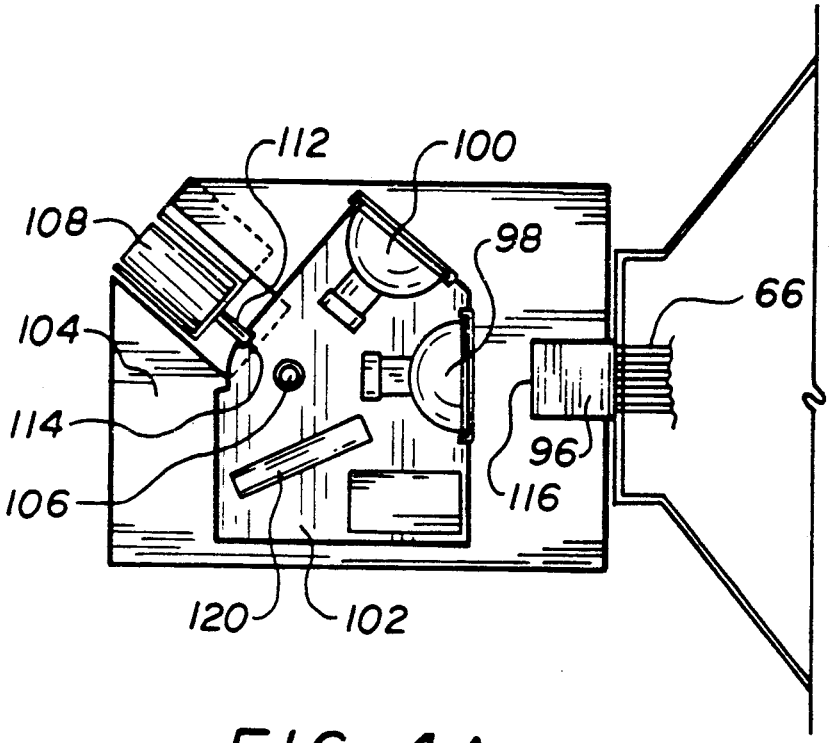
FIGS. 4A and 4B are detailed elevational views of the dual light source assembly of FIG. 3, shown in two alternative positions.
Figure 4B:
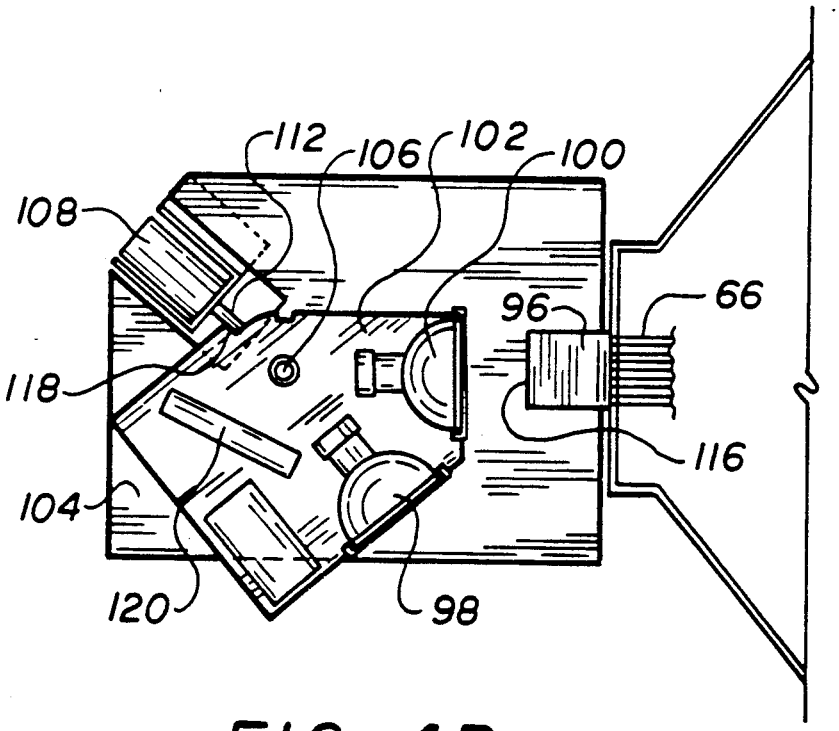

FIGS. 4A and 4B show the two positions of the rocker plate assembly. In the first position shown in FIG. 4A, light source 98 (also referred to as the primary light source) is aligned with the ferrule 96 containing the bundled ends of the fiber optic cables 66. The primary light source 98 is maintained in this aligned position by a plunger 112 extending from the solenoid 108 which engages a slot 114 on the perimeter of the rocker plate 102. In this position, the primary light source when energized shines light directly upon a generally planar light receiving surface 116 formed at the end of the ferrule 96 by the common light receiving end face of the bundled fiber optic cables.

The present invention provides means to sense a failure of the primary light source, energize light source 100 (also referred to as the secondary light source), and position the secondary light source 100 in alignment with the common ferrule 96, as shown in FIG. 4B. Alignment of the secondary light source with the ferrule is accomplished by energizing the solenoid to rotate the rocker plate 102 downward. By energizing the solenoid, the plunger 112 is withdrawn, enabling the rocker plate to rotate downward under the force of gravity. The rocker plate stops in the position wherein the secondary light source is aligned with the ferrule when the withdrawn plunger 112 engages a lip 118 on the perimeter of the rocker plate. In this position, a mercury switch 120 trips to energize the secondary light source, as will be described later.

Of course, the invention contemplates other manners of positioning the primary and secondary light sources with respect to the light receiving end faces of the fiber optic cables. For example, instead of pivoting about bolt 106, the light sources may be aligned parallel to the ferrule 96, the secondary light source above the primary. Upon actuation of the solenoid, then, the secondary light source may drop vertically into a position aligned with the ferrule 96.

The primary and secondary light sources used in the fiber optic display modules 12 are preferably halogen quartz lamps which are commercially available, for example General Electric model No. Q50MR-16-FL-1. These lamps typically have an operational life of around 5000–6000 hours. Such lamps generate a significant amount of heat, as well as light, when operative. For this reason, the present invention provides circulation means for cooling the lamps during operation.

Referring back to FIGS. 1A, 1B and 3, a blower 122 centrally located at the bottom of the aluminum enclosure 14 draws outside air through lower vent 124 into the enclosure and routes this air up through six air ducts 126. Air flows through each of the ducts 126 and over the light sources when the fiber optic display modules 12 are installed in the enclosure. Upper vents 128 in each of the ducts provide an exit for this air flow.

The portions of the display modules containing the light sources fit through openings 130 and into the ducts when the modules are swung inwardly toward the enclosure. Portions of the frames 104 of the modules cover the openings 130 to close the ducts 126. Thus, with the display modules installed in the enclosure, the light sources are provided with a closed ductwork system which draws outside air through lower vent 124, circulates the air over the energized light sources, and exhausts the circulated hot air through upper vents 128.

This ductwork system is provided with a pressure sensing device 132 which is adapted to remove power from the fiber optic light system should the vent 124 become blocked, thereby preventing the blower from drawing outside air into the ducts 126. Under normal operating conditions, the pressure within the ductwork is higher than atmospheric pressure due to circulating air flow. If the vent 124 should become blocked, the pressure sensing device senses a lowered pressure within the ductwork 126 and, if the pressure is sufficiently low, outputs a signal which actuates a switch 134. The switch 134 can be implemented to remove power to the system to prevent the quartz halogen lamps from overheating and failing. As will be described later, the display system may be programmed to display a default message should power be removed, using a back-up power source such as a battery.

In addition to the circulation system provided for the halogen light sources, the present invention provides a separate and independent circulation system for cooling the surface of the display elements. The surface temperature of the display elements is increased by heat produced by absorbed sunlight and the internal electronics, such as power transistors and ballasts for the fluorescent lamps 20. This circulation system comprises a series of four fans 136 located within four intake vents 138 located near the bottom of the enclosure, and four corresponding exhaust vents 140 located near the top of the enclosure.

Figure 5A:
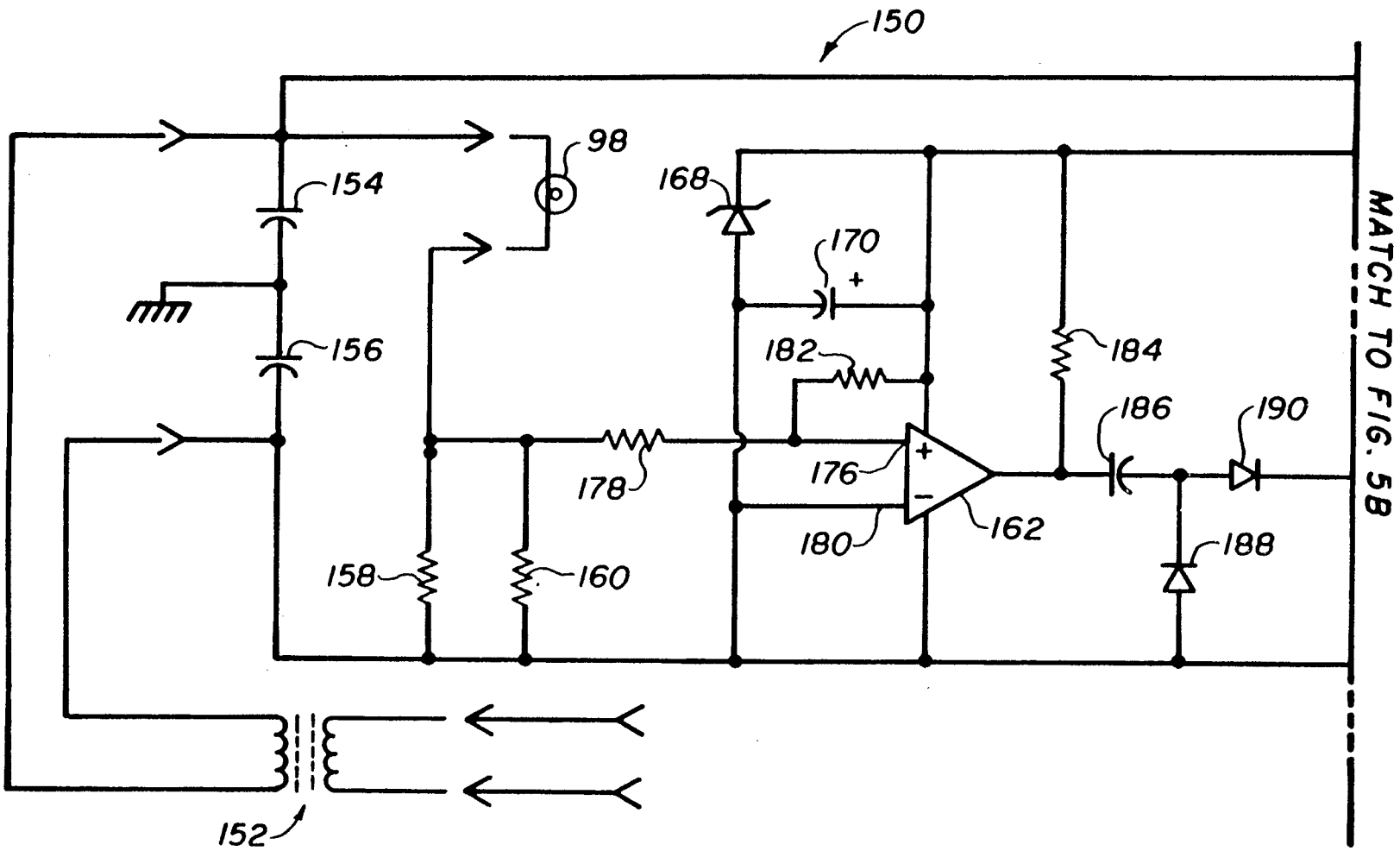
FIGS. 5A and 5B, taken together, are schematics of the current loss circuitry for controlling the position of the light source assembly of FIGS. 4A and 4B.
Figure 5B:
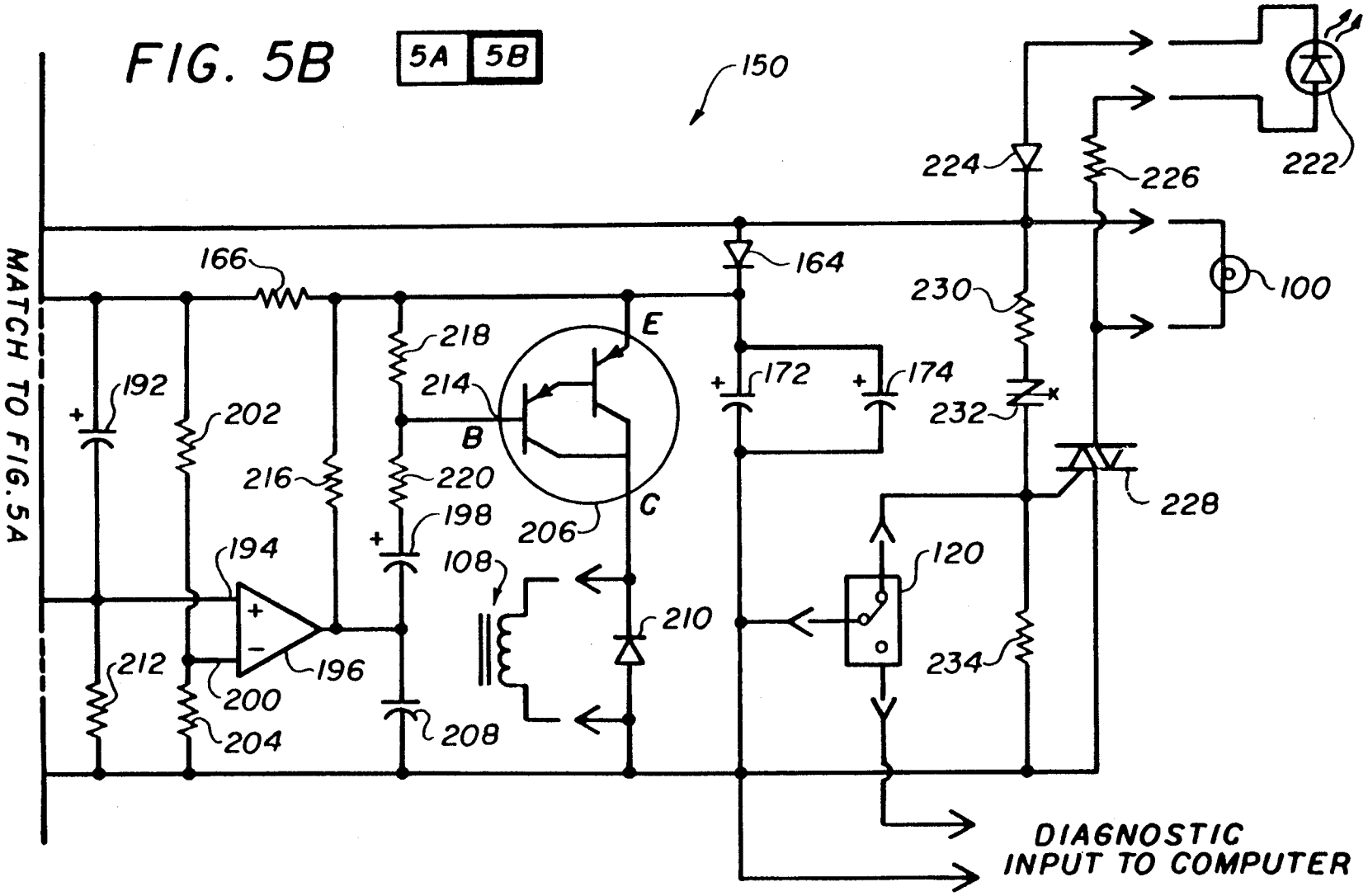

The circuit means for sensing a failure of the primary light source 98, energizing the secondary light source 100, and aligning the secondary light source with the bundled fiber optic cable light receiving end is shown in FIGS. 5A and 5B. The circuit 150 detects any interruption in the illumination of the primary light source and provides an electrical signal which is used to activate solenoid 108 to position and energize the secondary light source.

The power for operating the electronic and electromechanical devices in circuit 150, as well as for operating the primary and secondary light sources, is provided by standard 115 VAC single phase power. Providing power from the same supply for the light sources as well as the circuit elements insures that a changeover from primary to secondary light source will not occur upon loss of power to the primary light source. Instead, a light source changeover will occur only upon failure of the primary light source itself.

Transformer 152 steps the 115 VAC input voltage down by a factor of about ten to 10.5–11.5 VAC which is used to power the circuit. Bypass capacitors 154 and 156, both of which are rated at 0.1 uf and 100 volts, reduce the noise level present on this stepped down voltage signal. The primary light source 98 is paralleled across the stepped down voltage through a pair of parallel current sensing resistors 158 and 160, each of which is rated at 0.1Ω, 2 W. The voltage drop across these two resistors is insignificant (being in the 100 mV range) when the primary light is illuminated, and hence these resistors do not adversely affect the amount of power available for the primary light source. The presence of resistors 158 and 160 is necessary, however, to detect current loss should the primary light source fail.

A comparator 162 responds to any current loss detected by the resistors 158 and 160, and outputs a signal which triggers a sequence of events which eventually results in illumination of the secondary light source 100 and alignment of the secondary light source with the generally planar surface of the bundled ends of the cables. The comparator 162 is powered by a DC power source which is provided by diode 164 and is clamped to around six volts by resistor 166 (470Ω, 0.5 w) and zener diode 168. Capacitor 170 (100 uf) provides additional filtering for this DC signal, as do capacitors 172 and 174 (both 470 uf).

When the primary light source 98 is illuminated, the voltage drop across resistors 158 and 160 positively biases the signal applied to the noninverting input 176 of comparator 162 through resistor 178 (10KΩ) with respect to the floating ground signal 180 applied to the inverting input of the comparator. Resistor 182 is connected across the DC power supply and the noninverting input of the comparator to provide additional positive bias to the noninverting signal input.

The output of comparator 162 is generally a square wave when the primary light source is operative, due to the difference in voltage signals applied to the comparator inputs. A 2.2KΩ resistor 184 sources current for the output of the comparator, which is in an open collector configuration. The square wave output passes through 0.1 uf capacitor 186 to a voltage doubler circuit comprising diodes 188 and 190 (both 1N458A) and capacitor 192 (10 uf, 50 V). The output of the doubler circuit drives the noninverting input 194 of comparator 196 HIGH, leaving capacitor 198 (1OO uf, 25 V) only slightly charged. The inverting input 200 of comparator 196 is held at a fixed DC voltage level determined by resistors 202 and 204, the values of which are 1OKΩ and 3.3KΩ, respectively. The output of comparator 196 is thus driven HIGH, and a Darlington transistor 206 (2N6668) is shut off. The solenoid 108 is provided with no current, and its plunger 112 remains extended. The extended plunger remains engaged with the notch in the rocker plate upon which the light sources are mounted, so that the primary light source shines upon the generally planar surface formed by the bundled ends of the optical fibers.

If the primary light source should fail, the circuitry of FIGS. 5A and 5B provides means to move the secondary light source 100 into the position previously occupied by the primary light source 98. Initially, when the current through the primary light source ceases, no current will flow through current sensing resistors 158 and 160, and thus the 100 mV drop across the resistors will disappear. Both inputs to comparator 162 will be at floating ground potential, and hence the output of comparator 162 will be near zero volts. The doubling action of the doubling circuit will be insufficient to maintain the noninverting input 194 of comparator 196 HIGH, and the output of comparator 196 will be driven LOW. Capacitor 208 (0.001 uf) acts as a bypass for the comparator output. The LOW output of the comparator turns on the Darlington transistor 206, energizing the solenoid 108 which retracts its plunger 112. Diode 210 (1N4002) serves to protect the Darlington transistor 206. The secondary light source 100 then falls into place where the primary light source was previously located, as previously described.

The change in state of the output of comparator 196 is nearly instantaneous with the change in state of the noninverting input 194 to the comparator, because there is no feedback to the comparator. Thus the circuit of FIGS. 5A and 5B is designed to delay driving the noninverting input (and hence the output) of comparator 196 LOW for two to three seconds, thereby insuring that the primary light source 98 has indeed failed and has not only temporarily flickered. The desired delay is provided by the time constant introduced into the circuit by resistor 212 (470KΩ) and capacitor 192 (10 uf).

To conserve energy, it is also desirable to remove power to the solenoid once its plunger has retracted and the secondary light source has fallen into place. In fact, after the two to three second delay has passed, the Darlington transistor need only be turned on for 50–100 msec to trip the solenoid. The base 214 of the Darlington transistor is thus pulled LOW for 50–100 msec by the output of comparator 196, thereby turning the transistor ON. At this point, capacitor 198, which has only a slight voltage drop across its terminals due to the presence of resistor 216 (1KΩ), suddenly develops a greater voltage drop across its terminals and is gradually recharged by the circuit comprising resistors 218 and 220 (1KΩ and 2.2KΩ, respectively). With capacitor 198 charged, the base of the Darlington transistor is effectively turned OFF. The output of the comparator 196, however, remains LOW.

After the primary light source has been replaced, the rocker plate for the light sources may be pivoted upward so that the primary light source is again aligned with the generally planar surface formed by the bundled ends of the fiber optic cables. The output of comparator 196 is again driven HIGH, and capacitor 198 discharges through resistor 216. The circuit is then ready to sense the next failure of the primary light source.

In addition to providing the means to electromechanically align the secondary light source with the bundled ends of the optical fibers, the circuit of FIGS. 5A and 5B provides means to energize the secondary light source upon failure of the primary source, and means to indicate that a light source changeover has occurred. In the preferred embodiment, the indication means is a diagnostic LED 222 which is illuminated simultaneously with the secondary light source. A diode 224 (1N914B) insures that the LED is forward biased, and a resistor 226 (680Ω) limits the current available to the LED.

Upon electromechanical changeover from the primary to the secondary light source, mercury switch 120 trips to (i) provide the diagnostic signal required to light the LED 222 and (ii) energize the secondary light source 100. The mercury switch 120 may be any commercially available reliable, hermetically sealed, switching device. When the primary light source is operative, the switch position is as shown in FIG. 5B, and the gating signal to a triac 228 (SC 146B) is grounded. When the primary light source fails, the secondary light source falls into place thereby tripping the mercury switch, and the gating signal is ungrounded. A trigger circuit comprising a resistor 230 (125 3 W) and bilateral trigger diode 232 (MBS4993) simultaneously (i) switches the AC current to the secondary light source, and (ii) lights the diagnostic LED 222. Resistor 234 (220Ω) eliminates false triggering at low level outputs.

The present invention also provides means to provide the system controller with diagnostic information relating to (i) detection of system power loss (ii) occurrence of a light source changeover, and (iii) detection of faulty electromagnets on the indicator elements. FIGS. 6A through 6E illustrate the diagnostic waveforms processed by the controller during operation of the display system. FIGS. 7A and 7B taken together, show the diagnostic circuitry which interfaces between the system controller and the current loss detection circuit shown in FIGS. 5A and 5B. The diagnostic circuitry of FIGS. 7A and 7B notifies the system controller that the current loss detector circuit has sensed a current loss through one of the primary light sources and a secondary lamp has been energized. The diagnostic circuitry also notifies the system controller if power to the system has been interrupted, or if coils on the indicator electromagnets are faulty.

Figure 6A:
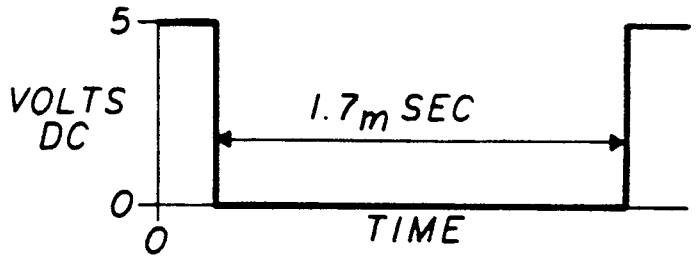
FIGS. 6A through 6E represent the digital logic signals processed by the system control unit.

FIGS. 6A through 6E are digital logic signals (0–5 V DC) processed by the system controller. FIG. 6A represents the coil enable waveform output by the controller when the controller determines that a particular indicator electromagnet should be energized. The controller identifies the indicator by its position with respect to the large matrix of indicators forming the system display surface. The coil enable waveform is normally HIGH and is driven LOW by the controller to energize a particular electromagnet. In the particular embodiment described, the enable line is driven LOW for 1.7 msec each time a coil is energized to flip an indicator element.

Figure 6B:
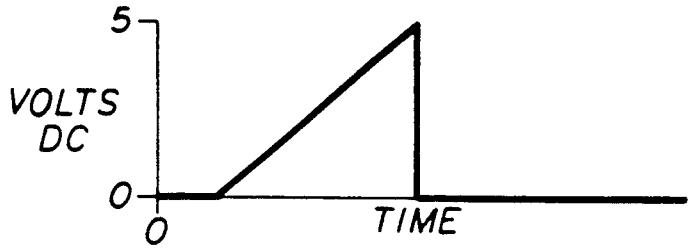
Figure 7A:
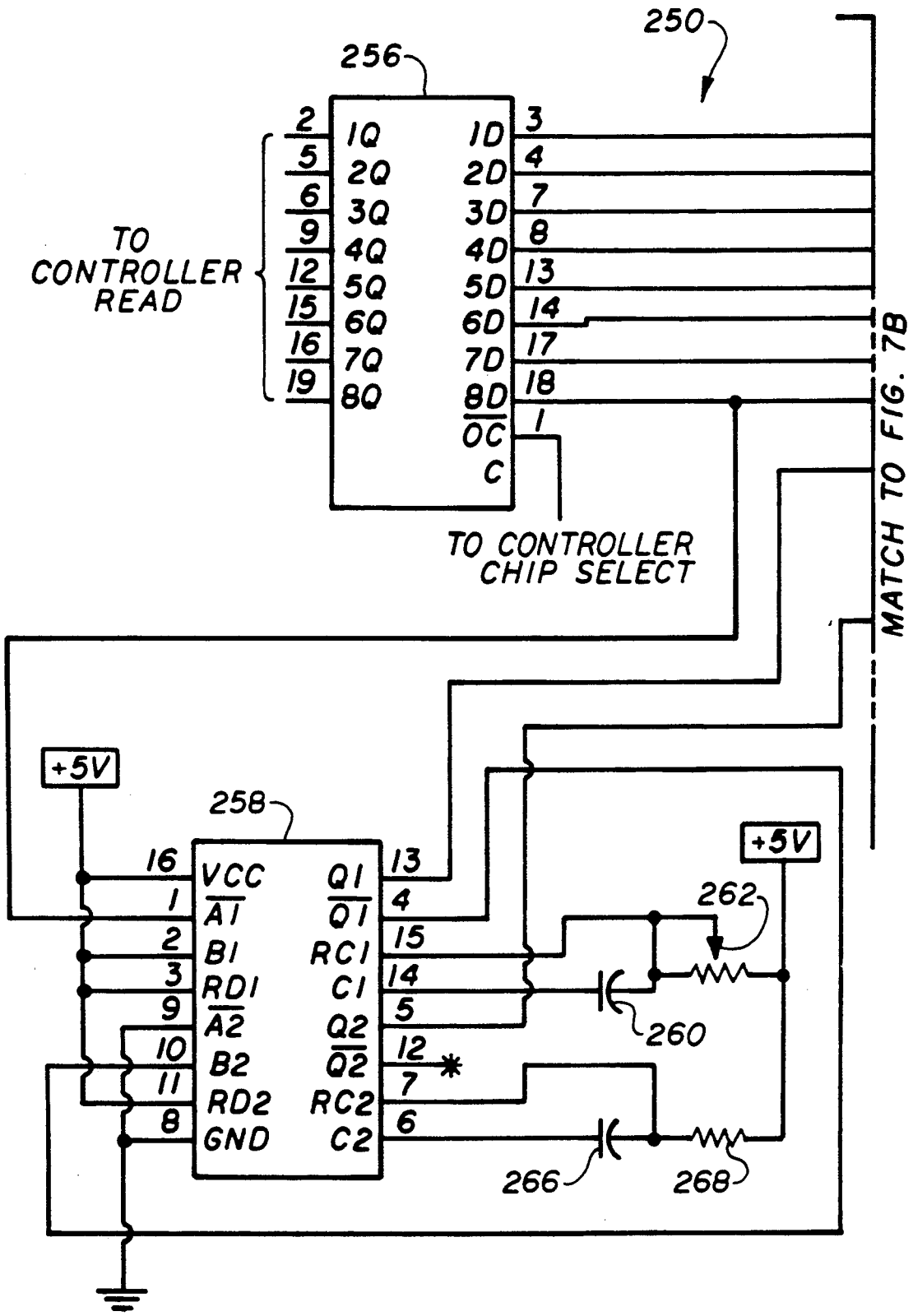
FIGS. 7A and 7B, taken together, are a schematic of the system diagnostic circuitry.
Figure 7B:
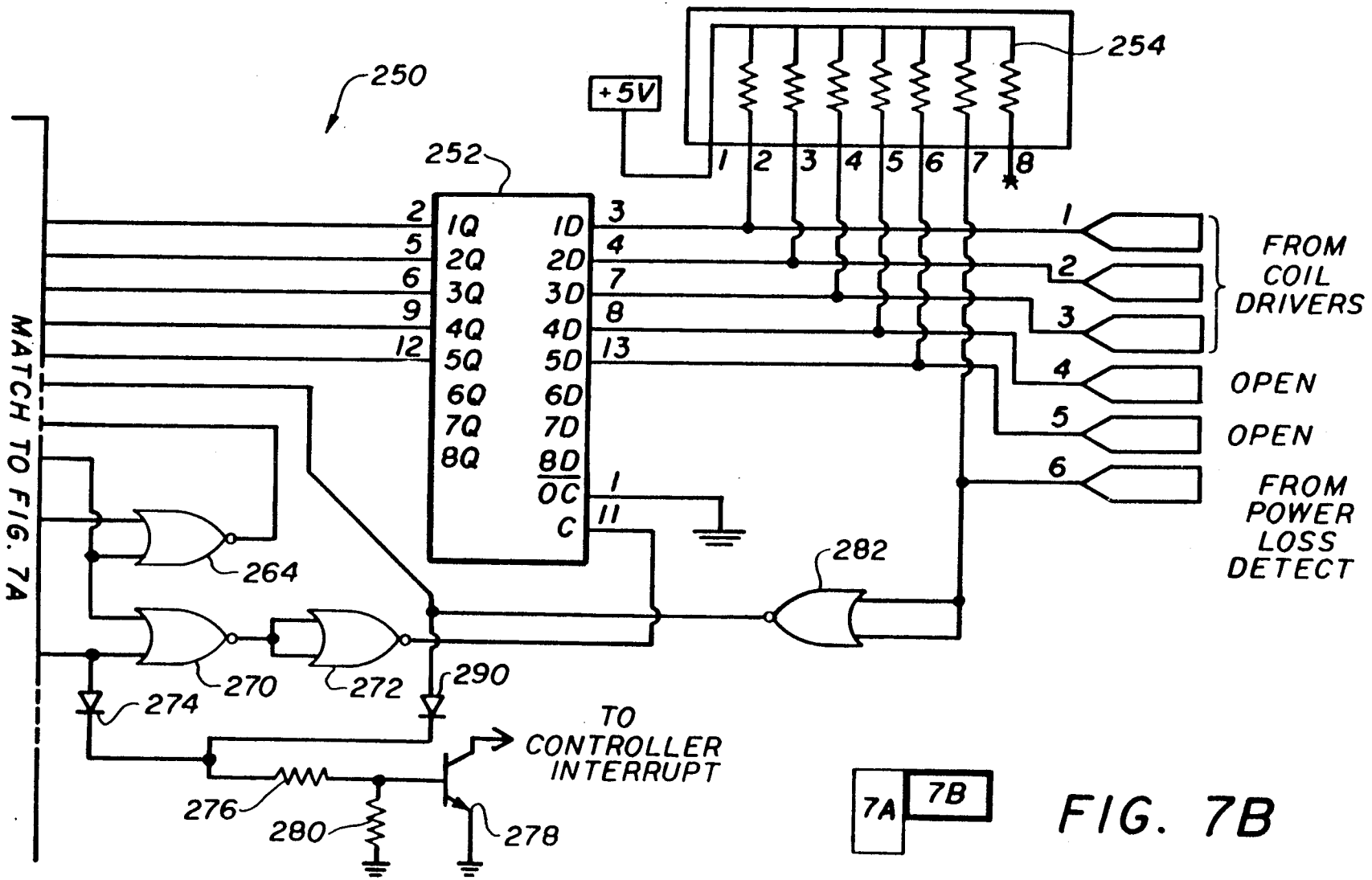

FIG. 6B represents the current through a particular indicator electromagnet coil when energized by the controller. 5 V DC represents the current at which the coil saturates, which in the preferred embodiment is around 6.2 amps. By the time the coil saturates, the electromagnet has developed an electromagnetic field sufficient to flip the flipper associated with that electromagnet. External current sensing circuitry (not shown) removes the current from the energized coil upon saturation to conserve energy consumption by the coils. Hence, the current does not flow through the electromagnet coil for the entire coil enable period as shown in FIG. 6A.

If a particular electromagnet coil is shorted, the current through that coil will rise sharply to 6.2 amps and then be turned off by the external current sensing circuitry. If the electromagnet coil is open, no current will flow through the coil during the entire coil enable period. However, if the particular coil is operating properly, the current through the coil will rise to 6.2 amps about halfway through the enable period and then be removed by the external current sensing circuitry. Thus, if the current through a particular coil is read by the controller (i) at a first time about halfway through the enable period and (ii) at a second time at the end of the enable period, the controller may determine if the coil is shorted, open, or properly operational. Specifically, the controller will sense a good coil only if the current through the particular coil is read HIGH halfway through the enable period and LOW at the end of the enable period.

Because the controller determines the duration of the coil enable period of FIG. 6A, the controller automatically reads the coil current data at the end of the enable period. In addition, the diagnostic circuitry 250 of FIGS. 7A and 7B permit the controller to detect the coil current halfway through the enable period. The coil current waveform data of FIG. 6B is sent to latch 252 (74LS374) at pins 3, 4 and 7 through a pull-up resistor pack 254 (3.3KΩ). These three inputs correspond to the three separate indicator arrays comprising the entire system display surface. This coil current information is passed to latch 256 to be read by the controller halfway through the coil enable period, as described below.

Figure 6C:
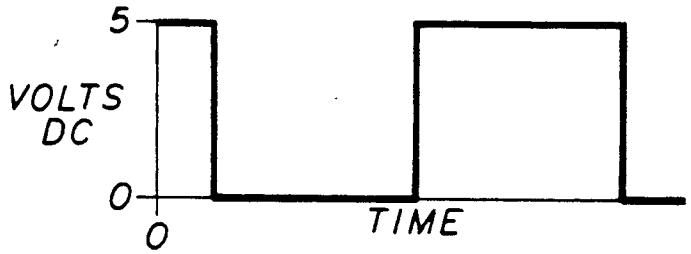

The coil enable waveform of FIG. 6A is simultaneously fed into (i) pin 18 of latch 256 (74LS373) so that it may be read by the controller at any time through pin 19 via the chip select line (pin 1), and (ii) pin 1 of monostable multivibrator 258 (74LS123). The monostable vibrator 258 comprises a variable time one-shot and a fixed time one-shot. When the coil enable waveform is initially driven LOW by the controller, the variable one-shot is triggered and outputs a delayed pulse at pin 4 after a predetermined time period (see FIG. 6C). The time is predetermined by capacitor 260 (0.1 uf) and resistor 262 (500KΩ variable). Thus, the variable one-shot may be tuned by adjusting resistor 262 so that the rising edge of its output pulse occurs about halfway through the coil enable period of FIG. 6A. The inverse of this variable one-shot output pulse and the coil enable waveform of FIG. 6A are input to a NOR gate 264. The output of this NOR gate, which is equivalent to the delayed pulse of FIG. 6C, is fed to pin 17 of latch 256 so that it may be read at any time by the controller at pin 17 via the chip select line.

Figure 6D:
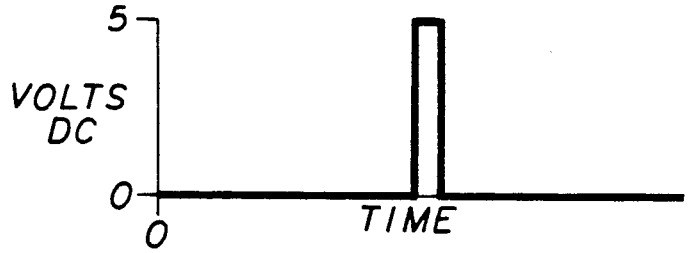
Figure 6E:
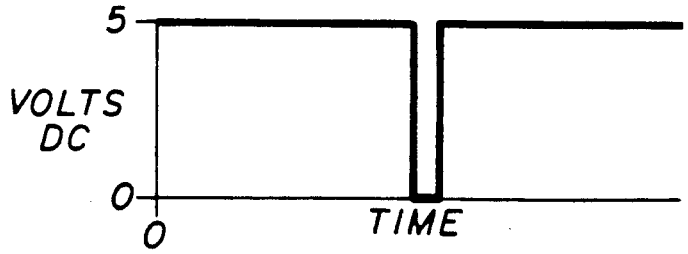

The variable one-shot output pulse (FIG. 6C) is used to trigger the fixed time one-shot of monostable vibrator 258. The fixed time one-shot outputs a pulse of short duration at pin 5 on the rising edge of the variable one-shot output pulse of FIG. 6C, as shown in FIG. 6D. The duration of this fixed time pulse is determined by capacitor 266 (0.0012 uf) and resistor 268(33KΩ). In the preferred embodiment, these resistance and capacitance values result in a fixed time pulse having a duration of about 50 microseconds. The fixed time one-shot pulse and the coil enable pulse of FIG. 6A are input to a NOR gate 270, and inverted through NOR gate 272 to provide the clock signal to pin 11 of latch 252. Upon the occurrence of the fixed time one-shot pulse, the coil current waveform data is sent to latch 256 to be read by the controller.

The controller is instructed to read the latch 256 upon the occurrence of the fixed time one-shot pulse by a controller interrupt signal (see FIG. 6E) generated from the fixed time one-shot pulse. The one-shot pulse is steered through diode 274 (1N914B), resistor 276 (1KΩ) and transistor 278 (MPSA06) and on to the controller. Resistor 280 (33KΩ) is used as a pull-down resistor. Thus, the controller is enabled to read the coil current waveform data through pins 2, 5 and 6 of latch 256 (i) halfway through the coil enable period upon occurrence of the controller interrupt signal and (ii) at the end of the coil enable period.

In addition, the diagnostics provided by the circuit of FIGS. 7A and 7B provide means to detect system power loss. In the preferred embodiment, the system is provided with a power fail device (not shown) which outputs a digital LOW signal upon loss of power to the system. This signal is pulled HIGH by the pullup resistor pack 254, inverted to LOW by NOR gate 282, and sent to pin 14 of latch 256 so that the loss of power condition may be read by the controller. The controller is instructed to read the latch at this time by a controller interrupt signal generated directly by the output of NOR gate 282. This output is steered through diode 290 (also a 1N914B) and transistor 278 and directed to the controller. Thus the controller may determine that power has been lost by reading pin 15 of latch 256 via the chip select line.

In the preferred embodiment, the power system for the display is provided with a battery backup power source in case primary power should be lost. This backup power source provides sufficient power for the display to change from the currently displayed message to a default message programmed in the controller. The controller is instructed to flip the indicator elements required for this default message when it reads the latch 256 and determines that system power has been lost.

Finally, the diagnostic circuitry of FIGS. 7A and 7B allows the controller to identify a light source changeover initiated by the current loss detection circuit of FIGS. 5A and 5B. Thus, the controller can determine which display modules in the system are operating with secondary light sources. In the preferred embodiment, the mercury switch output signal is fed through the coil driver circuitry and is treated as if it were a coil current signal. The diagnostic circuit 250 receives this data into each of pins 3, 4 and 7 of the latch 252, depending on which row of modules the particular light source is located. The signal is latched and read along with the current waveform data as described above. Thus, when the controller enables the coil pulse to the mercury switch, the coil driver circuitry will send either (i) open coil information if the primary light source is active or (ii) shorted coil information if the secondary light source is active. In the preferred embodiment, then, pins 8 and 13 of the latch 252 are left open and available for accepting additional diagnostic inputs.

Thus, the fiber optic display system of the present invention has been described in its preferred form. However, with the present disclosure in mind, it is understood that the present disclosure of the preferred embodiment is made only way of example, and that various changes may be implemented without departing from the true spirit and scope of the invention as hereinafter claimed.

We claim:

1. A fiber optic display device comprising:

a plurality of fiber optic cables for transmitting light, each of said cables having an end face for receiving light and an end face for emitting light, said light receiving end faces of said fiber optic cables being positioned in close proximity with each other to form a light receiving surface;

a light source assembly moveable with respect to said light receiving surface, said light source assembly comprising a primary light source and a secondary light source each adapted to illuminate said light receiving surface when aligned therewith, said light source assembly being alternatively moveable to a first position at which said primary light source is aligned with said light receiving surface or a second position at which said secondary light source is aligned with said light receiving surface;

a switch for alternatively energizing said primary and secondary light sources to illuminate said primary and secondary light sources;

electrical circuitry for detecting current loss through said primary light source and for providing an electrical signal in response thereto; and a solenoid having a plunger mechanically connected with said light source assembly for moving said light source assembly from said first position to said second position and for energizing said secondary light source in response to said electrical signal, said solenoid being electrically connected to said current loss detection circuitry.

2. A fiber optic display device comprising:

a plurality of fiber optic cables for transmitting light, each of said cables having an end face for receiving light and an end face for emitting light, said light receiving end faces of said fiber optic cables being positioned in close proximity with each other to form a light receiving surface;

a light source assembly moveable with respect to said light receiving surface, said light source assembly comprising a primary light source and a secondary light source each adapted to illuminate said light receiving surface when aligned therewith, said light source assembly being alternatively moveable to a first position at which said primary light source is aligned with said light receiving surface or a second position at which said secondary light source is aligned with said light receiving surface;

a switch for alternatively energizing said primary and secondary light sources to illuminate said primary and secondary light sources;

electrical circuitry for detecting current loss through said primary light source and for providing an electrical signal in response thereto;

a position mechanism for moving said light source assembly from said first position to said second position and for energizing said secondary light source in response to said electrical signal; and a mercury switch actuatable by said movement of said light source assembly from said first position to said second position, and at least one light emitting diode connected electrically thereto, for providing a visual indication of which of said primary and secondary light sources is energized.

3. A fiber optic display device comprising:

a plurality of fiber optic cables for transmitting light, each of said cables having an end face for receiving light and an end face for emitting light, said light receiving end faces of said fiber optic cables being positioned in close proximity with each other to form a light receiving surface;

a light source assembly moveable with respect to said light receiving surface, said light source assembly comprising a primary light source and a secondary light source each adapted to illuminate said light receiving surface when aligned therewith, said light source assembly being alternatively moveable to a first position at which said primary light source is aligned with said light receiving surface or a second position at which said secondary light source is aligned with said light receiving surface;

a switch alternatively energizing said primary and secondary light sources to illuminate said primary and secondary light sources;

detection circuitry for detecting an interruption in the illumination of said primary light source and for providing an electrical signal in response thereto;

a position mechanism for moving said light source assembly from said first position to said second position and for energizing said secondary light source in response to said electrical signal; and a blower for circulating outside air through a duct and over said light source assembly to cool said light source assembly.

4. The device of claim 3, wherein said detection circuitry comprises electrical circuitry for detecting current loss through said primary light source.

5. The device of claim 4, further comprising an indicator to provide a visual indication of which of said primary and secondary light sources is energized.

6. The device of claim 4, wherein a single power source supplies power to said primary and secondary light sources, said current loss detection circuitry, and said positioning mechanism.

7. The device of claim 3, further comprising a pressure sensitive device to sense the pressure level within said duct and to remove power from said light source assembly should said pressure level fall below a predetermined value.

8. A fiber optic display device comprising:

a plurality of fiber optic cables for transmitting light, each of said cables having an end face for receiving light and an end face for emitting light, said light receiving end faces of said fiber optic cables being positioned in close proximity with each other to form a light receiving surface, said light emitting end faces of said optical fibers terminating in a single generally planar display surface;

a light source assembly moveable with respect to said light receiving surface, said light source assembly comprising a primary light source and a secondary light source each adapted to illuminate said light receiving surface when aligned therewith, said light source assembly being alternatively moveable to a first position at which said primary light source is aligned with said light receiving surface or a second position at which said secondary light source is aligned with said light receiving surface;

a switch for alternatively energizing said primary and secondary light sources to illuminate said primary and secondary light sources;

electrical circuitry for detecting current loss through said primary light source and for providing an electrical signal in response thereto;

a position mechanism for moving said light source assembly from said first position to said second position and for energizing said secondary light source in response to said electrical signal; and at least one blower for circulating air over said generally planar display surface to cool said display surface.

* * * * *